United States Patent [19]

Nettro

[11] 4,264,886

[45] Apr. 28, 1981

[54] ON/OFF SWITCH

[75] Inventor: Ronald L. Nettro, Fern Creek, Ky.

[73] Assignee: General Electric Company, Louisville, Ky.

[21] Appl. No.: 89,813

[22] Filed: Oct. 31, 1979

[51] Int. Cl.[3] ..... H01H 3/00

[52] U.S. Cl. ..... 335/186; 335/163; 335/170

[58] Field of Search ..... 335/163, 170, 174, 229, 335/186, 254, 164

[56] References Cited

U.S. PATENT DOCUMENTS

| | | | |
|---|---|---|---|
| 1,522,208 | 1/1925 | Rukstelis | 335/170 |
| 3,568,114 | 3/1971 | Cherry | 335/186 X |
| 3,605,050 | 9/1971 | Goldman | 335/164 |
| 3,622,925 | 11/1971 | Rose | 335/186 |
| 3,733,568 | 5/1973 | Prouty et al. | 335/186 |
| 3,740,682 | 6/1973 | Schantz | 335/186 |
| 3,842,375 | 10/1974 | Collette | 335/186 X |
| 3,925,742 | 12/1975 | Muench | 335/164 X |

*Primary Examiner*—George Harris

*Attorney, Agent, or Firm*—H. Neil Houser; Radford M. Reams

[57] ABSTRACT

A switch assembly having an actuator rod for manually actuating the switch, a deactuator rod for manually deactuating the switch and an electromagnet for electrically deactuating the switch.

A spring biasing armature is pivotally mounted on a U-frame for movement within the switch housing. A pawl projects from the armature for engagement with a latching shoulder on the actuator rod. When the actuator rod is depressed to an actuated position which closes the switch contacts, the armature pivots to a position in which the pawl latchingly engages the latching shoulder on the rod and retains the rod in the actuated position.

The actuator rod is released from its actuated position by movement of the pawl out of latching engagement with the latching shoulder. Release is accomplished manually by depressing the deactuator rod which is mounted in alignment with the free end of the armature. Depression of the rod pivots the free end of the armature such that the pawl pivots out of latching engagement with the latching shoulder of the actuator rod. Release is accomplished electrically by energizing the electromagnet. The magnetic field attracts the free end of the armature, thereby pivoting the armature such that the pawl pivots out of engagement with the latching shoulder of the actuator rod.

5 Claims, 7 Drawing Figures

ON/OFF SWITCH

BACKGROUND OF THE INVENTION

This invention relates generally to electrical switches and more particularly to relay switches which must be closed mechanically and which may be opened both mechanically and electrically.

It is often desirable in the case of home appliances such as washers and dryers, dishwashers, and other appliances, to provide a main power switch which can be manually closed by the user to initiate appliance operation and which can be opened automatically at the end of the operating cycle and which may be quickly manually opened by the user, when desired, such as in the event of a malfunction situation or a need to abort the operating cycle. In appliances incorporating an electromechanical timer the timer is arranged to mechanically open a power switch at the end of the cycle. In addition, the user can manually turn the appliance ON and OFF by manipulating the timer control knob. However, in an electronically controlled appliance, the electromechanical timer is replaced by an electronic controller which does not employ a timer control knob. Thus, a switch separate from the electronic controller is needed to provide the desired mechanical ON and both a mechanical OFF and an electrical OFF power control capability for electronically controlled appliances.

It is additionally desirable for home appliances with electronic controllers that momentary interruptions in power not cause the ON/OFF switch to switch OFF. Typically, the memory devices of such electronic controllers are capable of retaining information for a matter of seconds. Thus, a momentary power interruption will not adversely affect appliance operation provided the ON/OFF switch remains on.

One type of Push-to-Start switch which can be employed in electronically controlled washers and dryers is of the type illustrated in U.S. Pat. No. 3,622,925 in which a manually operable switch after mechanical closure is magnetically maintained in closed position by electromagnetic means. In such a switch, opening of the switch at the end of the cycle is accomplished by de-energizing the electromagnetic means. Such a switch provides the mechanical ON and electrical OFF operating mode but not a mechanical OFF mode. A further disadvantage of such a switch is that in the event of even a momentary interruption of power the electromagnetic means is de-energized and the switch opens. Once opened, the switch remains open until subsequently manually closed by the operator.

It is therefore an object of this invention to provide an ON/OFF relay switch assembly which provides a manually operable mechanical ON and both a manually operable mechanical OFF and an automatic electrical OFF and which does not switch OFF in response to power interruptions.

It is a further object of this invention to provide an ON/OFF relay switch assembly of the above type which is reliable and which is structurally relatively simple and inexpensive to manufacture.

SUMMARY OF THE INVENTION

The present invention provides a switch assembly having an actuator rod for manually actuating the switch, a deactuator rod for manually deactuating the switch and an electromagnet for electrically deactuating the switch. The switch includes a housing which encloses a U-shaped mounting frame housing a frame base and a pair of legs projecting normally from each end of the base. The electromagnet is positioned within the U-frame and mounted to its base. An armature is pivotally mounted to one leg of the U-frame by a spring which biases the armature away from the electromagnet. A pawl is lanced out of the intermediate portion of the armature and bent so as to project generally perpendicularly therefrom toward the base of the U-frame. The actuator rod includes an external end portion projecting from the housing for manipulation by an operator, an internal end portion projecting through an opening in the base of the U-frame and a latching shoulder formed intermediate the end portions. The actuator rod extends through the opening formed in the armature by the lancing and bending of the pawl for selective engagement of the latching shoulder of a pawl. A biasing spring is mounted between the actuator rod and the U-frame and biases the actuator rod toward an outer or unlatched position. When the actuator rod is manually pushed inwardly of the housing to its latched position the latching shoulder moves to latching engagement with the pawl to retain the actuator rod in its inner, or actuated, position.

The actuator rod is released from its actuated position by appropriate movement of the armature pawl out of engagement with the latching shoulder. This is accomplished by pivoting the armature against the biasing force of its associated spring. When the electromagnet is energized the magnetic field attracts the free end armature to pivot the armature and thus pivot the pawl out of engagement with the latching shoulder. A deactuator rod is mounted in the switch housing in alignment with the free end portion of the armature. Manual depression of the deactuator rod causes it to move the free end of the armature and pivot the pawl out of engagement with the actuator latching shoulder.

A pair of spaced apart electrical terminals are positioned within the housing on the opposite side of the U-frame from the electromagnet. A resilient conductive finger is electrically and mechanically attached to one of the terminals and the free end of the finger is aligned with the other of the terminals. THe internal end portion of the actuator rod projects through the base of the U-frame to the finger. The resiliency of the finger urges the finger away from the other terminal and against the internal end portion of the actuator rod. When the actuator rod is depressed, that is manually moved from its deactuated to its actuated position, the internal end portion of the actuator rod flexes the finger and brings a contact carried by the free end portion of the finger into mechanical and electrical contact with the other terminal. When the actuator rod is moved from its inner or actuated position it frees the finger which returns to its unflexed position away from the other terminal.

DETAILED DESCRIPTION OF THE INVENTION

In the description to follow an illustrative embodiment of the ON/OFF relay switch assembly of the present invention is described as used in an automatic domestic clothes washer.

Figure 1:
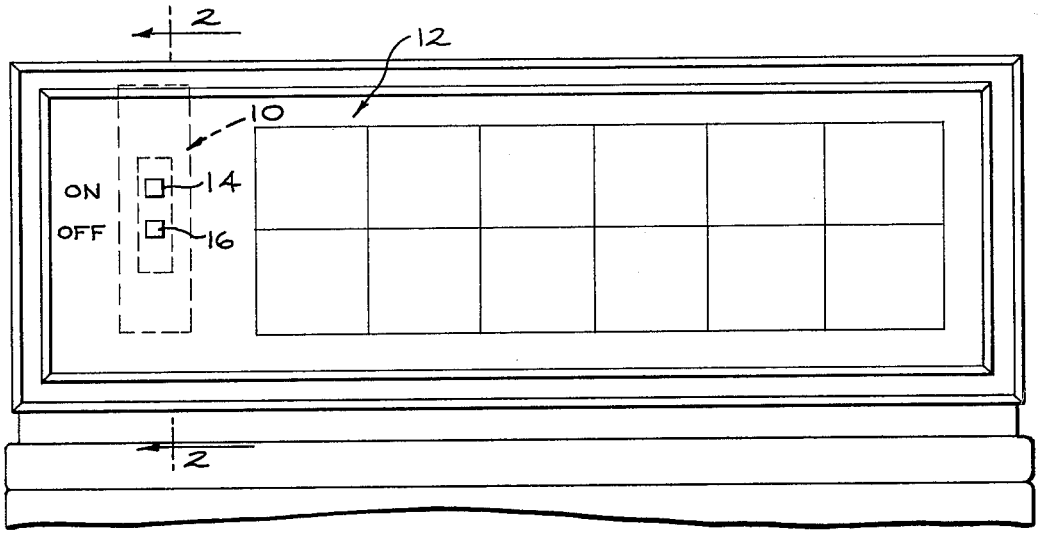
FIG. 1 is a front elevational view of the upper portion of a domestic clothes washing machine employing the illustrative embodiment of the relay switch of the present invention.

FIG. 1 shows an ON/OFF relay switch assembly 10 mounted to the escutcheon 12 of a clothes washer, with ON and OFF pushbuttons 14 and 16, respectively, projecting from the escutcheon.

Figure 2:
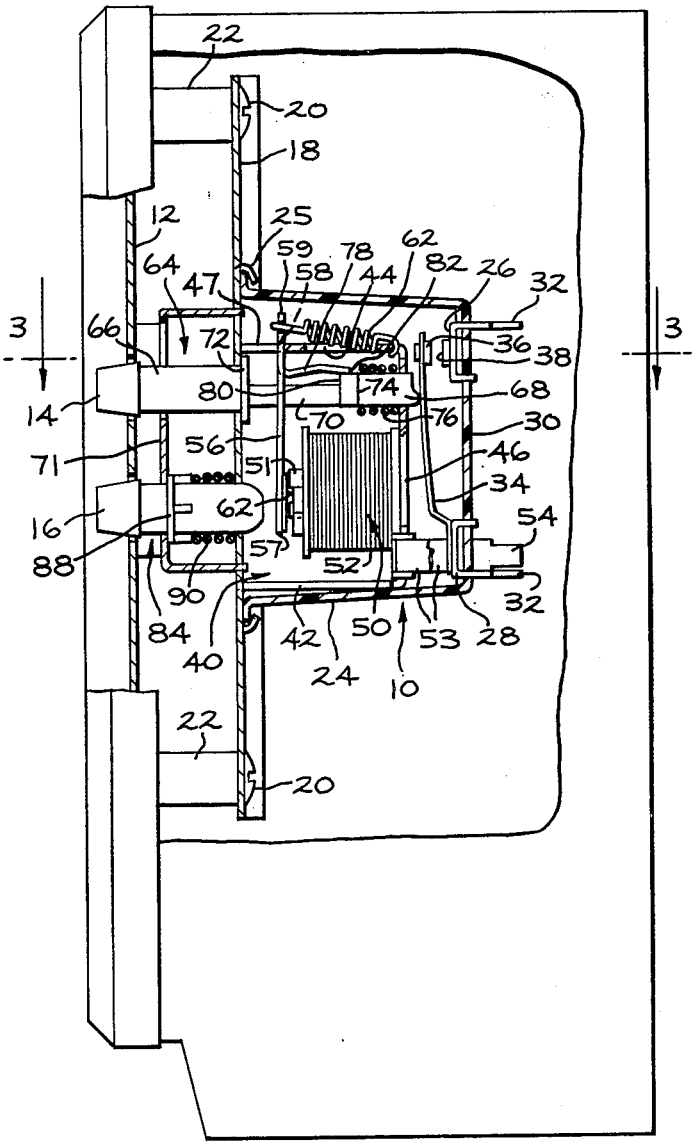
FIG. 2 is a view of the portion of the washing machine with portions cut away along line 2—2 of FIG. 1 to show the details of the illustrative embodiment of the relay switch of the present invention.
Figure 3:
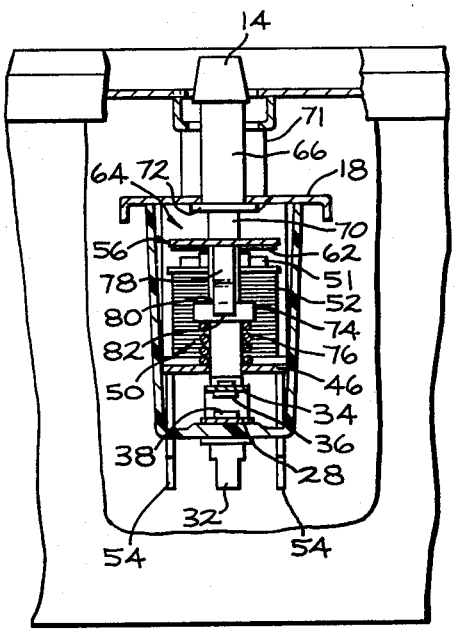
FIG. 3 is a sectional view taken along line 3—3 of FIG. 2.
Figure 5:
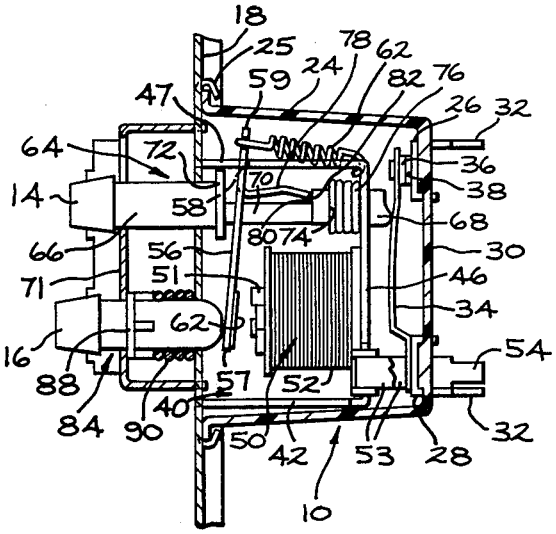
FIG. 5 is a cross-sectional side view of the relay switch of FIG. 2 showing the switch in its actuated position.

Details of switch assembly 10 illustratively embodying the present invention are best seen with respect to FIGS. 2 and 3. Switching assembly 10 includes a base plate 18 which is secured to the inner side of escutcheon 12 by suitable fastening means such as screws 20 which are received in bosses 22 formed integrally with and extending inwardly from escutcheon 12. A housing 24 preferably of plastic or a similar electrically insulative material is secured to base plate 18 by tabs 25. A pair of spaced apart electrical terminals 26 and 28 are mounted internally to the base 30 of housing 24. Each terminal includes a connecting tab 32 projecting externally from housing 24 for connection with an external electrical circuit. A resilient conductive finger 34 is fixed at one end in electrical contact with terminal 28. The free end of finger 34 extends into alignment with terminal 26. A contact button 36 is fixed to the free end of finger 34. A stationary contact button 38 is fixed to terminal 26 for engagement with contact 36. The resiliency of finger 34 biases finger 34 toward an open position in which contact 36 is remote from contact 38. Finger 34 is movable between its open position, shown in FIG. 2, and a closed position in which contact 36 is placed in electrical contact with contact 38, as shown in FIG. 5. Actuation of switch assembly 10 by an operator in a manner to be described hereinafter moves finger 34 to its closed position. In this closed position a closed electrical path is provided between terminals 26 and 28.

A U-frame 40 comprising legs 42 and 44 and base portion 46 is enclosed within housing 24 with the base portion 46 spaced from and generally parallel to finger 34. The ends of U-frame legs 42 and 44 are fixedly attached to base plate 18 by staking or other suitable means. An electromagnet 50 comprising a core 51, a coil 52 and a pair of electrical terminals 53, is mounted to the base of U-frame 40 between the arms 42 and 44. Electrical terminals 53 are connected to opposite ends of coil 52. Terminals 53 include connecting tabs 54 projecting through the base of housing 24 for electrical connection to an external circuit for energizing coil 52.

Figure 4:
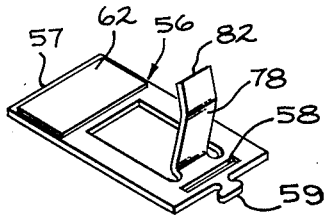
FIG. 4 is a perspective view of the armature employed in the illustrative embodiment of the present invention.
Figure 6:
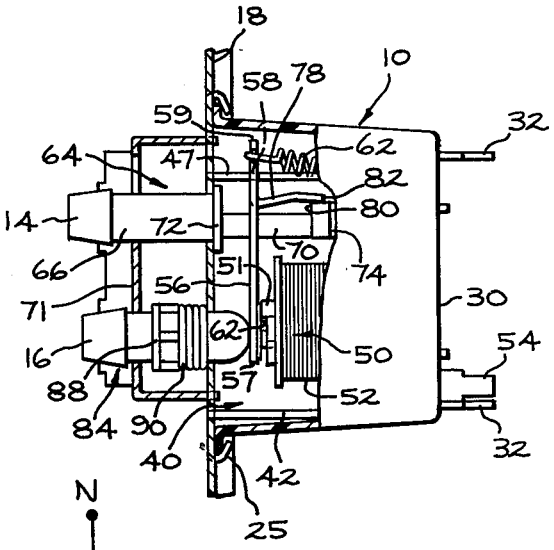
FIG. 6 is a side elevational view of the relay switch assembly of FIG. 2 with some portions broken away illustrating the switch in its mechanical position.

An armature 56 is pivotally mounted to leg 44 of frame 40. One free end 57 of armature 56 extends into alignment with the core 51 of electromagnet 50 for pivotal movement between a first position in which end 57 is adjacent to core 51 and a second position in which end 57 is remote from core 51. Adjacent, as used herein, includes in close proximity to core 51 as shown in FIGS. 2 and 3, or in engagement with core 51 as shown in FIG. 6. The second position remote from core 51 is shown in FIG. 5. In the illustrative embodiment pivotal mounting of armature 56 is achieved by a slot 58 in armature 56 near the end opposite end 57 (FIG. 4) which loosely receives reduced width end portion 47 of leg 44. The shoulder on leg 44 formed where end portion 47 joins the main portion of leg 44 engages the armature adjacent slot 58 and serves as a fulcrum for armature 56. Armature 56 is biased away from core 51 and toward its second position by tension spring 62 connected between a spring tab 59 of armature 56 and frame 40. As best seen in FIG. 4, a strip 62 is secured to armature 56 near end 57 on the side facing core 51. This strip serves as a magnetically insulating interface between core 51 and armature 56 to prevent residual magnetization of armature 56 by electromagnetic means 50. In the illustrative embodiment strip 62 is a strip of polyester film of the type manufactured by E. I. duPont de Nemours and Company, Inc. and sold under the brand name Mylar. In this arrangement, electromagnet 50 is operative when energized to overcome the bias of spring 62 and move end 57 of armature 56 toward core 51, thereby moving armature 56 to its first position. When the electromagnet is de-energized, it frees armature 56 for pivotal movement under the influence of spring 62 to its second position shown in FIG. 5.

Means for mechanical actuation of switch assembly 10 by an operator is provided in the form of an actuator rod 64 which includes an external end portion 66, an internal end portion 68, and a shank portion 70 of reduced cross-section therebetween. Actuator rod 64 is slidably received in aligned apertures in base plate 18, armature 56, the base 46 of frame 40 and support member 71 which is mounted to base plate 18 opposite U-frame 40 to provide structural stability to escutcheon 12. External end portion 66 of rod 64 projects from the housing 24 through base plate 18, support member 71 and escutcheon 12. ON pushbutton 14 is fixedly attached to the distal end of external end portion 64 for manipulation by an operator. A retaining shoulder 72 is formed on the external end portion 66 for engagement with the inner side of base plate 18 to retain the shank and internal end portion of rod 64 within housing 24. Internal end portion 68 projects through an aperture in base 46 of U-frame 40 for engagement with contact finger 34. Actuator rod 64 is axially movable between an outer or deactuated position in which the internal end portion 68 allows finger 34 to be in its open position (as seen in FIGS. 2 and 3) in which contact 36 is remote from contact 38, and an inner or actuated position in which the internal end portion of rod 64 has flexed finger 34 to its closed position with contact 36 engaging contact 38 (as seen in FIG. 5). A spring retaining shoulder 74 is formed on the internal end portion 68 of rod 64. A coil spring 76 is mounted about end portion 68 and engages retaining shoulder 74 and the base 46 of frame 40. Coil spring 76 biases rod 64 toward its deactuated position.

Means for latching actuator rod 64 in its actuated position is provided in the form of a pawl 78 carried by armature 56 and positioned to engage a latching shoulder 80 of actuator rod 64 when the rod is in its actuated position and the armature 56 is in its second position (see FIG. 5). Preferably, pawl 78 is formed by lancing and bending a portion of armature 56 so that pawl 78 rigidly projects from armature 56 at an angle preferably generally a right angle, as best seen in FIG. 4. Pawl 78 pivots in concert with armature 56 between an unlatched position and a latched position corresponding to the first and second positions, respectively, of armature 56. In switch assembly 10, rod 64 extends through the opening in armature 56 resulting from the formation of pawl 78, and the pawl is positioned generally adjacent and parallel to rod 64 (FIG. 2). Latching shoulder 80 is formed on rod 64 facing pawl 78 where shank portion 70 of reduced cross-section joins terminal end portion 68. With pawl 78 in its unlatched position and actuator rod 64 in its deactuated position, the tip 82 of pawl 78 is positioned to overlap shoulder 80 and slidingly engage the wall of internal end portion 68 of rod 64 between spring retaining shoulder 74 and latching shoulder 80, as shown in FIG. 2. Engagement of tip 82 by the wall of rod end portion 68 in this fashion prevents armature 56 from pivoting to its second position.

As best seen in FIG. 5, movement of actuator rod 64 from its deactuated position to its actuated position enables armature 56 to pivot to its second position in response to the biasing force of spring 62. Pawl 78 moves in concert with armature 56 and tip 82 of pawl 78 pivots to its latched position engaging latching shoulder 80. This engagement retains actuator rod 64 in its actuated position. Latching shoulder 80 is positioned such that the tip 82 of pawl 78 drops into engagement with shoulder 80 only after finger 34 has been moved by rod 64 to its closed position. This assures that the switch is actuated when the rod 64 is latched in its actuated position.

Electromagnet 50 enables electrical deactuation of switch assembly 10. As previously described, electromagnet 50, when energized, is operative to move the free end 57 of armature 56 into engagement with core 51. This pivots pawl 78 away from rod 64 causing tip 82 of pawl 78 to move out of engagement with latching shoulder 80. Movement of pawl 78 out of latching engagement with shoulder 80 allows spring 76 to move rod 64 to its deactuated position, thereby releasing finger 34 to move to its open position.

In addition to this electrical means for deactuating switch assembly 10, mechanical deactuating means is provided in the form of a deactuating member or rod 84 extending into housing 24 through the second aligned aperture in base plate 18 and a support member 71. The second aperture in support member 71 slidably supports deactuating member 84 and maintains member 84 in proper axial alignment. Deactuating member 84 includes an exterior portion which projects through the second aperture in support member 86 and through an aligned aperture in escutcheon 12, and an interior portion which projects through a similarly aligned aperture in base plate 18 into housing 24 for engagement with end 57 of armature 56. The OFF pushbutton 16 is mounted on the outer end of rod 84. Deactuating member 84 is axially movable between an outer or rest position and an inner or unlatching position. In its rest position (illustrated in FIG. 5) the interior end of deactuating member 84 is sufficiently spaced from the electromagnet so that the armature 56 can pivot to its first position and preferably engages end 57 of armature 56 when armature 56 is in its first position. In its unlatching position (illustrated in FIG. 6) the interior end of unlatching member 84 holds end 57 of armature 56 in its first position, adjacent core 52 of electromagnet 50. Deactuating member 84 includes an enlarged shoulder 88 for engaging the inner side of support member 71. This shoulder retains deactuating member 84 within support member 71. A coil spring 90 is positioned between shoulder 80 and base plate 18 for biasing deactuating member 84 toward its rest position. In this arrangement, deactuating member 84 is operative when depressed by an operator to move armature 56 from its second position to its first position. Spring 90 serves to return deactuating member 84 to its rest position when released by the operator.

Thus, as demonstrated by the illustrative embodiment and hereinafter described, this invention provides a switch assembly which is reliable, relatively simple structurally, inexpensive to manufacture, and which overcomes the deficiency of the prior art by providing an ON/OFF relay requiring mechanical actuation to close the switch and enabling opening the switch either mechanically or electrically, and which is not adversely affected by temporary power interruption.

Figure 7:
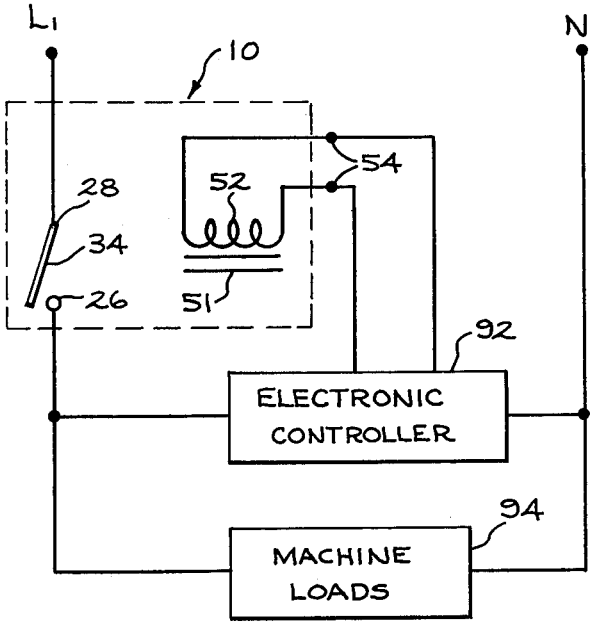
FIG. 7 is a simplified schematic representation of a control circuit for the washing machine of FIG. 1 employing the relay switch assembly of FIG. 2.

A control circuit for the clothes washer incorporating the switch assembly of the present invention is illustrated schematically in FIG. 7. In this circuit, lines L1 and N are power lines are adapted for connection to a typical domestic household 60 Hz 110 volt AC power supply, L1 being the so-called hot line and N being the neutral line. L1 is connected to terminal 28 of switch assembly 10. Terminal 26 of switch assembly 10 is connected to the electronic controller 92 which controls appliance operation and to block 94 which represents various machine loads such as the appliance motor and solenoid actuated valves. It is apparent from FIG. 7 that all power to the appliance is provided through switch assembly 10. Terminals 54 are shown connected to output lines from electronic controller 92 which provide a DC energizing signal to the coil at the appropriate time in the operating cycle as determined by controller 92. In the illustrative embodiment, the energizing signal is a 24 volt DC full wave rectified unfiltered signal.

Operation of switch assembly 10 will now be described with reference to FIGS. 2, 5, 6 and 7. FIG. 2 shows switch assembly 10 in its deactuated position. In this position, the electrical path between terminals 26 and 28 is open and no power is being applied to the appliance. To turn the appliance ON, the operator depresses pushbutton 14. As actuating rod 64 is moved by the operator from its deactuated to its actuated position by the depression of pushbutton 14, finger 34 is moved to its closed position by rod 64 and the tip 82 of pawl 78 drops into engagement with latching shoulder 80 in response to the biasing force of spring 62. Switch terminals 26 and 28 are thus closed and armature 56 is thus pivoted to its second position with end 57 remote from core 51, as illustrated in FIG. 5. Actuator rod 64 will remain in this actuated position, held by pawl 78 until armature 56 is pivoted from its second position to its first position either mechanically or electrically. Mechanical deactuation is accomplished by the operator depressing pushbutton 16 and moving deactuating member 84 from its rest position shown in FIG. 5 to its unlatching position shown in FIG. 6. As deactuating member 84 is moved it moves end 57 of armature 56 to its first position adjacent core 51. Movement of end 57 of armature 56 to this position pivots pawl 78 causes pawl tip 82 to move out of latching engagement with shoulder 80. This releases actuator rod 64 and it returns to its deactuated position in response to the biasing force of spring 76. The position assumed by armature 56 when switch assembly 10 is electrically deactuated is shown in FIG. 2 and is the same as that shown in FIG. 6, the difference being that deactuating member 84 remains in its rest position. When electrically deactuated, end 57 of armature 56 is placed in magnetic contact with core 51. End 57 is moved to this position and held there by the electromagnetic field generated by electromagnetic means 50 when coil 52 is energized by a DC signal from electronic controller 92. As previously described, placement of armature 56 in this position pivots pawl 78 such that pawl tip 82 is moved out of engagement with latching shoulder 80 thereby releasing actuator rod 84, permitting it to return to its deactuated position. Upon removal of the deactuating force from armature 56, either mechanical or electromagnet, after releasing actuator rod 64 to return to its deactuated position, armature 56 may pivot slightly out of contact with core 51 in response to the biasing force of spring 62 to a position in close proximity to core 51 as shown in FIG. 2. Armature 56 is retained in this position by the engagement of pawl 78 with the wall of internal end portion 68 of rod 64 as hereinbefore described.

It is apparent from the foregoing description that applicant's invention as illustrated in the embodiment described herein above provides an ON/OFF switch relay requiring mechanical actuation for closure and providing for rapid mechanical opening as well as electrical opening of the switch and which is relatively simple in operation and construction yet which provides reliable operation. Mechanical actuation avoids the problem of inadvertent closure caused by electrical transients in the line, the mechanical latching arrangement prevents inadvertent opening of the switch due to temporary power failures or power interruption and the mechanical OFF enables the operator of the appliance to positively and rapidly interrupt power to the appliance at any time in the operating cycle.

While a specific embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. An electrical switch comprising:

a base plate;

a housing mounted to said base plate;

a U-frame comprising a base and two legs extending from said base, enclosed in said housing, each leg being attached at its end to said base plate;

electromagnetic means mounted to said base of said U-frame and adapted for energization from a first external electrical circuit;

an armature pivotally mounted to one leg of said U-frame, one end of said armature extending into alignment with said electromagnetic means; said armature being movable between a first position in which said one end is adjacent to said electromagnetic means and a second position in which said one end is relatively remote from said electromagnetic means;

means for urging said armature toward its second position;

an actuator rod slidably received in aligned apertures in said base plate, said armature and said base of said U-frame for movement between an actuated position and a deactuated position; said actuator rod including an external end portion protruding from said housing, an internal end portion projecting through said base of said U-frame, a shank portion between said exterior and interior end portions and a latching shoulder formed at the junction of said shank portion and said internal end portion;

means for biasing said actuating rod toward its deactuated position;

a pawl extending from said armature, adjacent and generally parallel to said actuator rod for engagement with said actuator rod; said pawl pivoting in concert with said armature between an unlatched position and a latched position corresponding to the first and second positions, respectively, of said armature;

said pawl being positioned for sliding engagement with said internal end portion of said actuator rod when said actuator rod is in its deactuated position and operative to pivot to a latched position in latching engagement with said shoulder when said actuator rod is in it actuated position for retaining said actuator rod in its actuated position;

a deactuator rod slidably received in said housing for movement between a rest position and an unlatching position; said deactuator rod including an external end portion projecting from said housing through a second aperture in said base plate, and an interior end portion positioned to engage said one end of said armature when said armature is in its second position and move said one end of said armature to its first position as said deactuator rod moves from its rest position to its de-latching position;

a pair of switch terminals mounted within said housing and projecting externally therefrom for connection to second externalelectrical circuit;

a resilient conductive finger having one end thereof fixedly mounted in electrically conductive contact with one of said switch terminals and having its other end extending into alignment with said other switch terminal, said conductive finger being positioned for engagement by said internal end of said actuator rod so that movement of said actuator rod from its deactuated position to its actuated position moves said finger from an open position with its other end remote from the other of said switch terminals to a closed position with its other end in electrical contact with said other terminal, said finger providing a conductive path between said terminals when in its closed position, said finger being resiliently biased for return to its open position when said actuator rod moves from its actuated to its deactuated position;

whereby said finger is moved to its closed position by movement of said actuator rod to its actuated position and held in this position until said actuating rod is released.

2. A manually operable electrical switching apparatus comprising:

a housing;

a U-frame mounted within said housing including a base and two legs;

electromagnetic means mounted to said base and adapted for energization by a first external electric circuit;

an armature pivotally mounted to one leg of said frame, one end of said armature extending into alignment with said electromagnetic means; said armature being pivotally movable between a first position in which said one end is adjacent to said electromagnetic means and a second position in which said end is remote from said electromagnetic means;

means for biasing said armature toward its second position;

said electromagnetic means being operative when energized to move said armature to its first position;

an actuator member slidably received in aligned apertures in said armature and said frame, and manually movable from an deactuated position to an actuated position; said actuator member including a latching shoulder;

means for biasing said actuator member toward its deactuated position;

a pawl extending from said armature adjacent said actuator member, and pivotally movable in concert with said armature between an unlatched position and a latched position corresponding to said first and second armature positions, respectively;

said pawl being constructed and arranged to assume its unlatched position in which the tip of said pawl overlaps said latching shoulder in sliding engagement with said actuating member when said actuator member is in its unactuated position and to pivot into its latched position in which the tip of said pawl latchingly engages said shoulder when said actuator member moves to its actuated position;

said pawl being operative in its latched position to retain said actuator member in its actuated position;

deactuating means manually movable between a rest position and an unlatching position, said deactuating means being constructed and arranged to move said armature from its second position to its first position when said deactuating means is manually moved from its rest position to its unlatching position;

and contact means including a pair of spaced apart electrical terminals mounted to said housing and adapted for connection in a second external electric circuit, said contact means being constructed and arranged to electrically connect said terminals when said actuating member is in its actuated position and to disconnect said terminals when said actuating member is in its unactuated position.

3. A switching apparatus in accordance with claim 2 wherein said actuator member comprises an actuator rod having an external end portion protruding from said housing for manual operation thereof, an internal end portion which projects through said base of said U-frame, and a shank portion of reduced cross section therebetween, said shoulder being formed at the junction of said shank portion and said internal end portion; said rod being axially movable between its actuated and unactuated position, said pawl extending from said armature generally parallel to said rod, said means for biasing said armature urging said pawl toward said actuator rod.

4. A switching apparatus in accordance with claim 2 or 3 wherein said deactuating means comprises a deactuating rod including an external end portion projecting from said housing for manual operation thereof and an internal end portion, said rod being manually axially movable between said rest position and said unlatching position, said internal end portion of said deactuating rod engaging said end of said armature when said armature is in its second position and moving said end of said armature into close proximity with said electromagnetic means as said deactuating rod moves from its rest position to is unlatching position, thereby pivoting said armature to its first position and releasing said actuator means from its actuated position;

said deactuating means further comprising spring means for biasing said deactuating rod toward its rest position.

5. A switching apparatus in accordance with claim 4 wherein said contact means comprises a resilient conductive finger, fixed at one end in electrical contact with one of said terminals, the free end of said finger extending into alignment with the other of said terminals, said finger being positioned for engagement by said internal end portion of said actuator rod so that movement of said actuator rod from its deactuated position to its actuated position moves from an open position remote from said other terminal to a closed position in electrical contact with said other terminal thereby providing a conductive path between said terminals in said closed position; said finger being resiliently biased for return to its open position when said actuator rod moves from its actuated to its deactuated position;

said free end of said finger extending into alignment with said interior end portion of said first rod for engagement therewith, said first rod being operative to move said finger from its open to its closed position in moving from its unactuated position to its actuated position.

* * * * *